United States Patent [19]

Cone

[11] Patent Number: 4,834,269

[45] Date of Patent: May 30, 1989

[54] LIQUID CONTAINER

[76] Inventor: Robert L. Cone, Yoder Rd., RD 2, Elverson, Pa. 19520

[21] Appl. No.: 937,657

[22] Filed: Dec. 4, 1986

Related U.S. Application Data

[63] Continuation-in-part of Ser. No. 771,084, Aug. 30, 1985, Pat. No. 4,658,975.

[51] Int. Cl.[4] ..... A47G 19/14

[52] U.S. Cl. ..... 222/465.1; 220/94 A

[58] Field of Search ..... 222/465 R, 470, 374, 222/376; 220/94 A, 94 R; 215/100 A

[56] References Cited

U.S. PATENT DOCUMENTS

| | | | |
|---|---|---|---|
| D. 194,486 | 1/1963 | Hill | D9/374 |
| D. 213,821 | 4/1969 | Platte | D9/40 |
| D. 238,654 | 2/1976 | Platte | D9/40 |
| D. 265,797 | 8/1982 | Platte | D9/378 |
| D. 271,113 | 10/1983 | Birkeland et al. | D9/376 X |
| D. 274,307 | 6/1984 | Ledda | D9/376 X |
| D. 274,698 | 7/1984 | Epperson | D9/376 X |
| 2,512,105 | 6/1950 | Kooij | 220/94 A X |
| 3,171,559 | 3/1965 | Ferree | 215/1 |
| 3,207,298 | 9/1965 | Wilson | 222/465.1 |
| 3,443,710 | 5/1969 | Hills | 215/1 |
| 4,257,525 | 3/1981 | Thompson | 220/94 R |
| 4,638,928 | 1/1987 | Webster | 222/465.1 |

FOREIGN PATENT DOCUMENTS

| | | | |
|---|---|---|---|
| 633803 | 7/1963 | Belgium | 222/465.1 |
| 670424 | 9/1963 | Canada | 220/94 A |
| 1168822 | 4/1964 | Fed. Rep. of Germany | 220/94 A |
| 8425312 | 2/1984 | Fed. Rep. of Germany | . |
| 1316168 | 12/1962 | France | . |
| 2532621 | 9/1983 | France | . |
| 2528389 | 12/1983 | France | . |
| 1058527 | 2/1967 | United Kingdom | . |
| 2061868 | 10/1979 | United Kingdom | . |

*Primary Examiner*—Joseph J. Rolla
*Assistant Examiner*—Kenneth Noland
*Attorney, Agent, or Firm*—Panitch, Schwarze, Jacobs and Nadel

[57] ABSTRACT

A liquid container provided with a peripheral wall which forms a closed chamber and at least partially bounds a region external to the chamber. The user's arm may be inserted within the bounded region to grip a pouring handle which defines a fulcrum about which the container may be tilted during pouring. The portion of the peripheral wall bounding the region external to the chamber is contacted by the user's arm during pouring to stabilize the container. A discharge port is located near the container bottom so that the containers may be tilted only over a relatively small angle with respect to the vertical to substantially empty the container. A transparent hose having a graduated scale and coupled to the discharge port provides a visual indication of liquid level in the container before and after pouring.

10 Claims, 3 Drawing Sheets

LIQUID CONTAINER

RELATED APPLICATION

This application is a continuation-in-part of copending application Ser. No. 771,084 titled "Liquid Container" filed Aug. 30, 1985 in the name of the inventor herein now U.S. Pat. No. 4,658,975.

BACKGROUND OF THE INVENTION

The present invention is directed to a liquid container having separate carrying and pouring handles and a valved discharge. A peripheral wall defines a closed chamber for storing liquid and at least partially bounds a region exterior to the chamber. The pouring handle is in the form of a post disposed within the bounded region exterior to the chamber. A portion of the wall is contacted by the user's arm when the post is gripped so that the container is supported by one arm during pouring.

In U.S. Pat. No. 3,443,710, there is disclosed a liquid container having a pair of openings 38*a*, 38*b* flanking a post 42. The arrangement defines a pair of body handles which may be tightly gripped to carry the container.

In U.S. Pat. No. 3,171,559, there is disclosed a container having an opening in which a card or label may be inserted.

U.S. Pat. No. Des. 213,821, 238,654 and 265,797 disclose various designs for container side handles.

French Pat. No. 2,528,389 discloses a container wherein trenches (slots) are cut into the container body. The container is made of plastic.

The problem solved by the present invention is that of providing a pouring handle and a discharge port on the container so that the container can be substantially emptied of liquid by supporting the container with one hand and tilting the container over a relatively small angle with respect to the vertical and so that the level of liquid in the container can be indicated to the user before and after pouring.

BRIEF SUMMARY OF THE INVENTION

A liquid container comprising a peripheral wall forming a closed chamber for storing a liquid, a portion of said periheral wall being shaped so as to at least partially bound a region exterior of the chamber, a pouring handle comprising a post connected to said portion of said peripheral wall and disposed within said region so that said post can be gripped by a user and said peripherall wall portion contacted by the user's arm, said post defining a fulcrum about which the container may be tilted, and a discharge port disposed near the bottom of the container.

For the purpose of illustrating the invention, there is shown in the drawings forms which are presently preferred; it being understood, however, that this invention is not limited to the precise arrangements and instrumentalities shown.

DETAILED DESCRIPTION OF THE INVENTION

Figure 1:
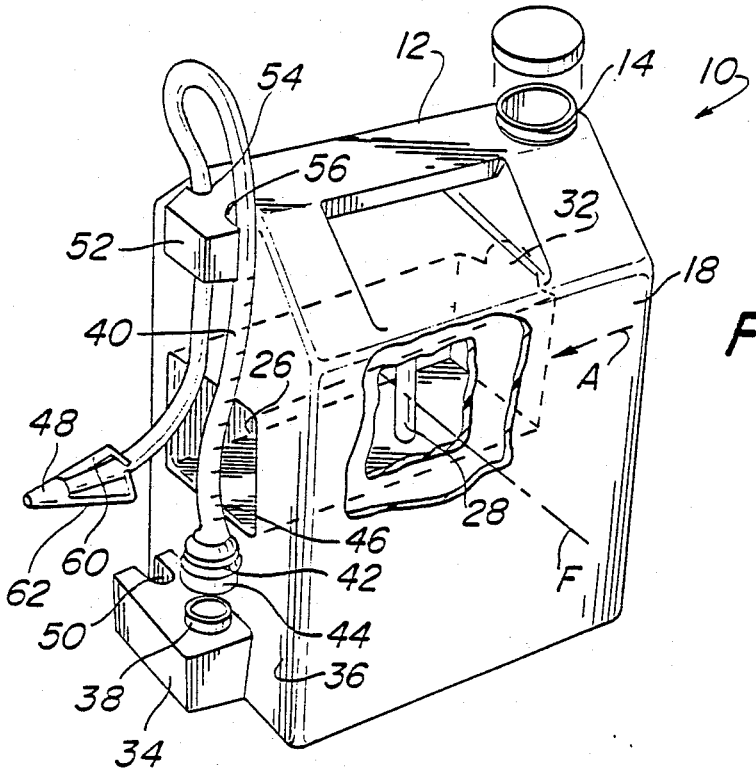
FIG. 1 is an isometric of one embodiment of a liquid container of the present invention.
Figure 2:
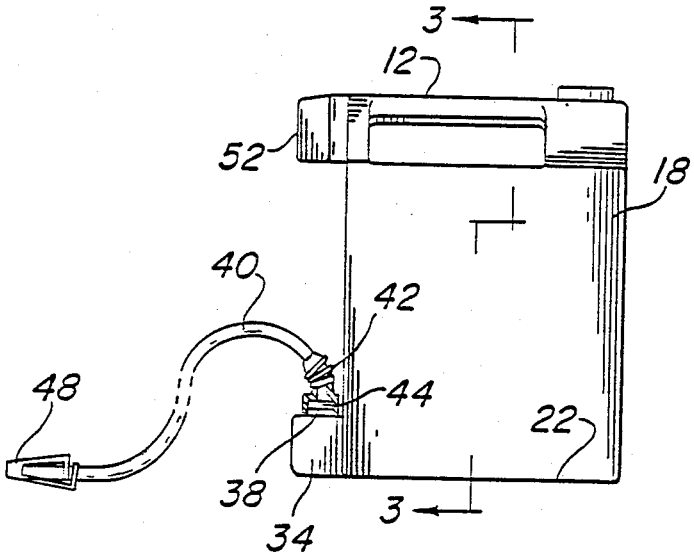
FIG. 2 is a side elevation of the liquid container shown in FIG. 1.
Figure 3:
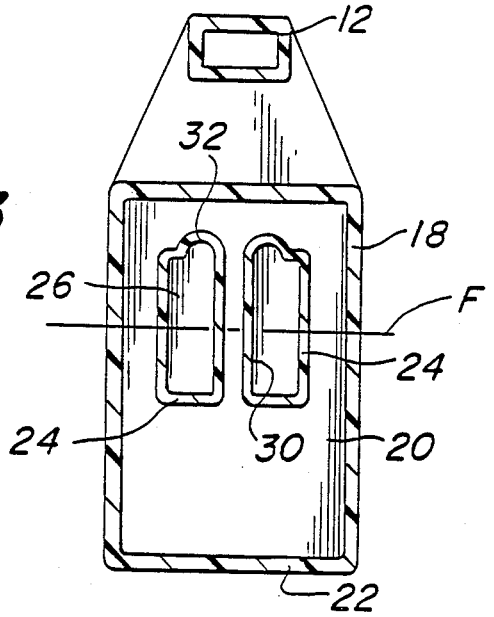
FIG. 3 is a section taken along the lines 3—3 in FIG. 2.

Referring to the drawings, wherein like numerals indicate like elements, there is shown in FIG. 1 an isometric of the liquid container of the present invention designated generally as 10. The container is preferably blow molded and made of a suitable polymeric plastic material such as polyethylene. The container includes a carrying handle 12 and an inlet port surrounded by a threaded lip 14. An internally threaded sealing cap 16 may be screwed onto lip 14 after liquid is introduced through the inlet opening into the container. The container shape is defined by a continuous peripheral wall 18 which defines a closed chamber 20 for storing liquid such as gasoline, kerosene, detergent, oil, water, liquid foodstuff, garden chemicals, etc. The peripheral wall is made of an inert, rigid or semi-rigid material, so as to retain the shape as shown in the drawings, and the wall may be opaque, translucent or transparent. The peripheral wall 18 is flattened at the bottom of the container so as to define a base 22 which allows the container to be placed on a flat surface such as a storage shelf of the like.

Peripheral wall 18 includes a portion 24 which is shaped so as to at least partially bound a region 26 exterior of chamber 20. A pouring handle in the form of a post 28 is connected to wall portion 24 to facilitate pouring as described hereafter. The post 28 is itself defined by portion 30 of the peripheral wall 18, portion 30 being integrally connected to wall portion 24. The wall portion 24 is shaped so that the cross-section of bounded region 26 is of a dimension to permit the user's arm to extend comfortably therein. The wall portion 24 bounding region 26 includes an arcuate shaped recessed portion 32 which is dimensioned so as to receive the user's arm to assist in supporting the container during pouring. Post 28 is disposed within region 26 so as to allow sufficient space around the post so that it can be gripped by the user's hand.

A discharge port is formed in a projection 34 of peripheral wall 18. The projection 34 is connected to an end panel 36, which is part of peripheral wall 18, proximal the bottom of the end panel. The discharge port is surrounded by a threaded lip 38. A flexible, tubular hose 40 is coupled to lip 38 by a flexible coupling 42 having an internally threaded cap 44 which screws on to lip 38. It should be understood that lip 38 and cap 44 need not be threaded and may be provided other suitable fastening structure as would be apparent to one of skill in the art given this disclosure. Preferably, the hose is made of a transparent plastic material and may be provided with a graduated scale 46 to indicate the level of liquid in the hose prior to and after pouring.

A clamp valve 48 is coupled to the free end of hose 40 so as to regulate discharge of liquid from the hose. The projection 34 is provided with a latch in the form of a detent 50 within which the nose end of clamp valve 48 may be frictionally secured when not in use.

A lug 52 is formed in peripheral wall 18 so as to overhang the top region of end panel 36. The lug 52 is provided with a pair of latches in the form detents 54, 56 within which a medial portion of hose 42 may be frictionally secured when not in use.

When the container is filled with liquid, a pressure head is developed at the discharge port near the bottom of end panel 36 whereby liquid flows by gravity into hose 40. When the container is upright, the level of liquid in hose 40 is the same as the level of liquid in the container and is indicated by scale 46. To discharge liquid through the hose, the user inserts his arm inside bounded region 24, in the direction indicated by arrow A in FIG. 1, grips post 28 with his hand, and tilts the container. Thus, the post 28 provides a fulcrum F (indicated in chain lines) about which the container is tilted during pouring. As the container is being tilted, the user's arm contacts the arcuate, recessed wall portion 32 whereby the user's arm is "locked" in place thereby stabilizing the container during pouring.

During pouring, then, the container is supported by the user's hand and arm. The user's free hand is placed on clamp valve 48, and the valve is manipulated to discharge liquid over a given application area. Clamp valve 48 is particularly desirable in applying liquids such as garden chemicals over a particular surface area.

Figure 4:
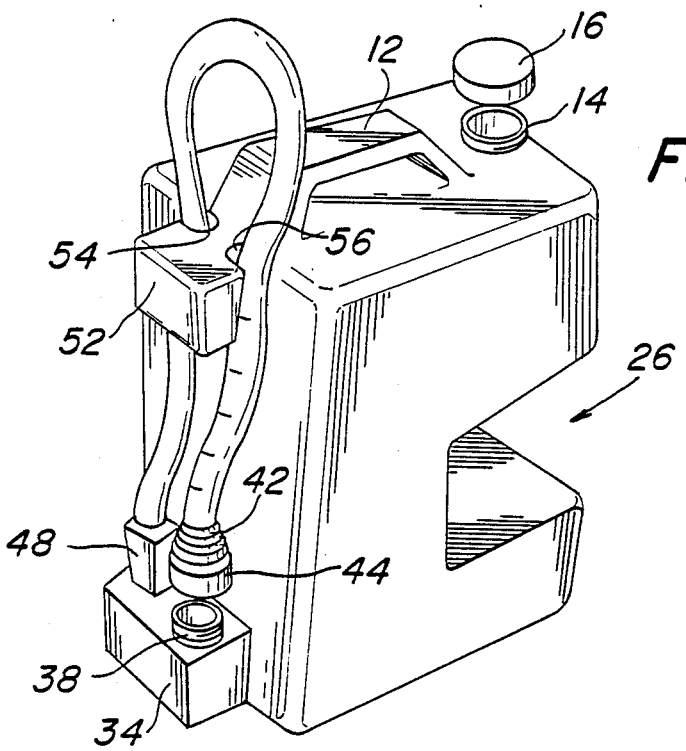
FIG. 4 is an isometric of another embodiment of the liquid container of the present invention.
Figure 5:
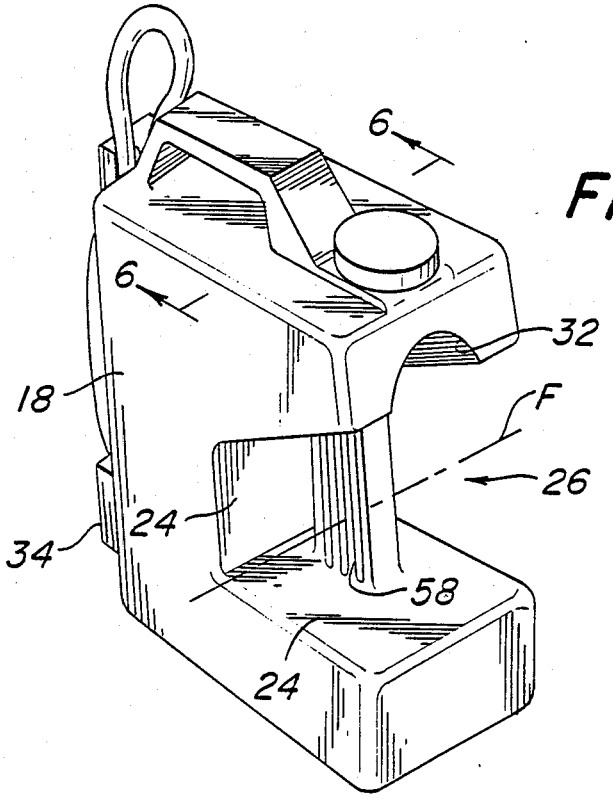
FIG. 5 is a further isometric of the embodiment shown in FIG. 4.
Figure 6:
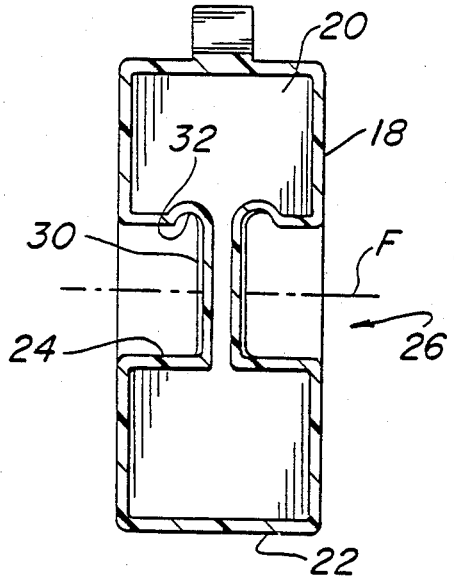
FIG. 6 is a section taken along the lines 6—6 in FIG. 5.

The shape of bounded region 24 external and to the chamber 18 may be modified as shown in FIG. 4 wherein region 24 is open at three sides to the container exterior thereby enhancing access to the pouring handle 28. The pouring handle 28 may also be modified as shown in FIG. 5 so as to have a generally rectangular shape which conforms to the palm area of the user's hand. The exterior of the pouring handle may be provided with ribs 58 to provide a sure grip surface. To further enhance access to the pouring handle, the upper portion of wall portion 24 which includes arcuate, recessed portion 32 is angled with respect to the horizontal.

Because the discharge port is located near the bottom of the container, for both embodiments, the container can be conveniently tilted while supported on a shelf or other like surface without using pouring handle 28. Thus, the container may be positioned on a shelf such that the base of the container proximal the discharge port overhangs the shelf edge. The user may then grasp carrying handle 12 and tilt the container so as to discharge liquid, using the shelf edge as a fulcrum point. To pour liquid from the container when the container is used off the shelf, the user's arm is inserted in region 26. Post 28 is gripped by the user's hand and the user's arm seats in the arcuate, recessed wall portion 32 to ensure stability and control of container orientation. Thus, the container is supported by one arm during pouring and the user's free hand can manipulate clamp valve 48, by squeezing tongs 60, 62 together to regulate discharge flow. Preferably, the discharge port is formed in projection 34 and is located near the bottom of the container. Accordingly, a pressure head is maintained at the discharge port so that liquid level in the container is displayed by the hose scale and so that liquid can be discharged freely through the hose by tilting the container about the fulcrum F defined by post 28 at relative small angles with respect to the vertical.

Although embodiments of the invention have been described wherein the peripheral wall 18 is formed by blow molded polyethylene, it should be appreciated that other materials are also suitable for use. For example, other inert plastics, glass or metallic materials may be employed. The particular material is not limiting. In addition, although a continuous peripheral wallis desirable, the container may also be constructed in parts and assembled by suitable bonding techniques to form a unified container body. The container shape and dimension may be varied as desired to increase or reduce the liquid storage capacity of the container.

The present invention may be embodied in other specific forms without departing from the spirit or essential attributes thereof and, accordingly, reference should be made to the appended claims, rather tha to the foregoing specification, as indicating the scope of the invention.

I claim:

1. Liquid container comprising:

a peripheral wall forming top, side, end and bottom portions of the container which enclose a chamber for storing a liquid, a portion of said peripheral wall being shaped so as to at least partially bound a region exterior of the chamber which opens inwardly from an end portion of the container, a pouring handle comprising a post connected to said portion of said peripheral wall and disposed within said region, said region having a depth such that a user's hand and arm can be inserted therein, said post and peripheral wall portion being arranged so that said post can be gripped by a user's hand while at least an upper part of said peripheral wall portion is contacted by the user's arm to support the container therealong, and a discharge port disposed near the bottom portion of the container at another end portion of the container.

2. Liquid container comprising:

a peripheral wall forming top, side, end and bottom portions of the container which encloses a chamber for storing a liquid, a portion of said peripheral wall being shaped so as to at least partially bound a region exterior of the chamber which opens inwardly from an end portion of the container, on upper part of said portion of said peripheral wall including a recessed portion, a pouring handle comprising a post connected to said portion of said peripheral wall bounding said region and disposed within said region, said region having a depth such that a user's hand and arm can be inserted therein, said post and peripheral wall portion being arranged so that said post can be gripped by a user's hand while at least a part of said recessed wall portion is contacted by the user's arm to support the container therealong, and a discharge port disposed near the bottom portion of the container at another end portion of the container.

3. Liquid container comprising:

a peripheral wall forming top, side, end and bottom portions of the container which enclose a chamber for storing a liquid, a portion of said peripheral wall being shaped so as to at least partially bound a region exterior of the chamber which opens inwardly from an end portion of the container, said region being open to said container exterior along at least two sides of the container, a pouring handle comprising a post connected to said portion of said peripheral wall and disposed within said region, said region having a depth such that a user's hand and arm can be inserted therein, said post and peripheral wall portion being arranged so that said post can be gripped by a user's hand while at least an upper part of said peripheral wall portion is contacted by the user's arm to support the container therealong, and a discharge port disposed near the bottom portion of the container at another end portion of the container.

4. Liquid container according to claims 1, 2 or 3 including a conduit coupled to said discharge port and having a free end portion for dispensing liquid therefrom, and means for securing said conduit in a storage position.

5. Liquid container according to claim 4 wherein said conduit is a flexible, tubular member.

6. Liquid container according to claim 4 including a hand manipulable valve coupled to said conduit.

7. Liquid container according to claim 4 wherein said conduit is transparent.

8. Liquid container according to claim 7 wherein said conduit is provided with a graduated scale for indicating the level of liquid within the container.

9. Liquid container according to claims 1, 2 or 3 wherein said peripheral wall is made of polyethylene.

10. Liquid container according to claims 1, 2 or 3 wherein said portion of said peripheral wall bounding said region includes a wall portion which is angled with respect to the horizontal.

* * * * *